US009803313B2

(12) United States Patent
Ryoo et al.

(10) Patent No.: US 9,803,313 B2
(45) Date of Patent: Oct. 31, 2017

(54) CLOTHES TREATING APPARATUS

(71) Applicant: LG ELECTRONICS INC., Seoul (KR)

(72) Inventors: Byeongjo Ryoo, Seoul (KR); Daeyun Park, Seoul (KR); Yongju Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/982,434

(22) Filed: Dec. 29, 2015

(65) Prior Publication Data

US 2016/0186374 A1 Jun. 30, 2016

(30) Foreign Application Priority Data

Dec. 29, 2014 (KR) ..... 10-2014-0192542

(51) Int. Cl.
*D06F 58/28* (2006.01)
*D06F 58/20* (2006.01)
(Continued)

(52) U.S. Cl.
CPC ..... *D06F 58/28* (2013.01); *D06F 25/00* (2013.01); *D06F 58/02* (2013.01); *D06F 58/206* (2013.01);
(Continued)

(58) Field of Classification Search
CPC ..... F26B 19/00; F26B 23/00; F26B 25/00; D06F 58/02; D06F 58/206; D06F 58/28;
(Continued)

(56) References Cited

U.S. PATENT DOCUMENTS 3,290,793 A 12/1966 Jacobs et al.
3,610,002 A 10/1971 Carpigiani
(Continued)

FOREIGN PATENT DOCUMENTS

CN 2595848 12/2003
CN 1695029 11/2005
(Continued)

OTHER PUBLICATIONS

Korean Office Action dated Jul. 6, 2015.
(Continued)

*Primary Examiner* — Stephen M Gravini
(74) *Attorney, Agent, or Firm* — KED & Associates, LLP

(57) ABSTRACT

A clothes treating apparatus is provided that may include an accommodation chamber, in which an object may be accommodated; a first heat pump cycle having a first evaporator, a first compressor, a first condenser, and a first expansion valve; a second heat pump cycle having a second evaporator, a second compressor, a second condenser, and a second expansion valve, and arranged such that air introduced into the accommodation chamber passes through the first evaporator, the second evaporator, the second condenser and the first condenser, sequentially; and a controller configured to control an operation of the first and second heat pump cycles. At least one of the first compressor or the second compressor may be provided with an inverter that changes a drive speed of the compressor through a frequency conversion. The controller may drive the at least one of the first compressor or the second compressor within a predetermined drive range, by controlling the drive speed of the at least one of the first compressor or the second compressor using the inverter.

11 Claims, 11 Drawing Sheets

(51) Int. Cl.
*D06F 25/00* (2006.01)
*D06F 58/02* (2006.01)

(52) U.S. Cl.
CPC ..... *D06F 2058/287* (2013.01); *D06F 2058/2816* (2013.01); *D06F 2058/2861* (2013.01)

(58) Field of Classification Search
CPC ..... D06F 25/00; D06F 2058/2816; D06F 2058/2861; D06F 2058/287
USPC ..... 34/595–610, 86; 62/442
See application file for complete search history.

(56) References Cited

U.S. PATENT DOCUMENTS

| | | | | |
|---|---|---|---|---|
| 3,739,487 | A | 6/1973 | Clark | |
| 6,745,495 | B1 * | 6/2004 | Riddle | D06F 58/28 34/493 |
| 7,020,985 | B2 | 4/2006 | Casey et al. | |
| 8,050,034 | B2 * | 11/2011 | Ootani | H05K 7/20681 165/104.19 |
| 8,082,677 | B2 | 12/2011 | Noviello | |
| 8,129,931 | B2 * | 3/2012 | Maekawa | H02P 21/14 180/65.225 |
| 8,387,273 | B2 * | 3/2013 | Driussi | D06F 58/206 165/11.1 |
| 8,418,377 | B2 | 4/2013 | Grunert et al. | |
| 8,601,717 | B2 | 12/2013 | Beers et al. | |
| 8,615,895 | B2 | 12/2013 | Shin et al. | |
| 8,695,230 | B2 * | 4/2014 | Noh | D06F 58/206 34/402 |
| 8,707,581 | B2 | 4/2014 | Quaroni et al. | |
| 9,097,462 | B2 * | 8/2015 | Lorenc | D06F 58/206 |
| 9,207,015 | B2 * | 12/2015 | Ahn | D06F 58/02 |
| 9,356,542 | B2 * | 5/2016 | Ragogna | D06F 58/206 |
| 9,359,714 | B2 * | 6/2016 | Contarini | D06F 58/203 |
| 9,372,031 | B2 * | 6/2016 | Contarini | D06F 58/206 |
| 9,435,069 | B2 * | 9/2016 | Contarini | D06F 58/206 |
| 9,534,329 | B2 * | 1/2017 | Contarini | D06F 39/02 |
| 9,637,852 | B2 * | 5/2017 | Song | D06F 37/203 |
| 9,640,174 | B2 * | 5/2017 | Noh | G10L 15/00 |
| 2005/0066538 | A1 | 3/2005 | Goldberg et al. | |
| 2005/0204755 | A1 | 9/2005 | Nishiwaki et al. | |
| 2008/0235977 | A1 | 10/2008 | Kuwabara | |
| 2010/0170101 | A1 | 7/2010 | Taniguchi et al. | |
| 2010/0307018 | A1 | 12/2010 | Driussi | |
| 2011/0289794 | A1 | 12/2011 | Noh et al. | |
| 2012/0210597 | A1 * | 8/2012 | Bison | D06F 58/206 34/524 |
| 2012/0246962 | A1 | 10/2012 | Lee | |
| 2014/0041400 | A1 | 2/2014 | Cavarretta | |
| 2014/0109426 | A1 | 4/2014 | Ahn et al. | |
| 2014/0109428 | A1 | 4/2014 | Kim et al. | |
| 2014/0223758 | A1 | 8/2014 | Bison et al. | |
| 2014/0338218 | A1 | 11/2014 | Contarini et al. | |
| 2015/0033806 | A1 * | 2/2015 | Cerrato | D06F 39/005 68/5 C |
| 2015/0308034 | A1 * | 10/2015 | Cavarretta | D06F 58/28 62/79 |
| 2015/0308035 | A1 * | 10/2015 | Cavarretta | D06F 58/28 34/482 |
| 2015/0322619 | A1 * | 11/2015 | Bison | D06F 58/28 34/487 |
| 2016/0040349 | A1 * | 2/2016 | Ros | D06F 58/28 34/319 |
| 2016/0160427 | A1 * | 6/2016 | Lee | D06F 58/206 34/443 |
| 2016/0186374 | A1 * | 6/2016 | Ryoo | D06F 58/206 34/86 |

FOREIGN PATENT DOCUMENTS

| | | |
|---|---|---|
| CN | 1766212 | 5/2006 |
| CN | 101099071 | 1/2008 |
| CN | 101310068 | 11/2008 |
| CN | 201358383 | 12/2009 |
| CN | 102105631 | 6/2011 |
| CN | 201864982 | 6/2011 |
| CN | 102859063 | 1/2013 |
| DE | 1 827 021 | 2/1961 |
| DE | 43 07 372 | 9/1994 |
| DE | 4 409 607 | 10/1994 |
| DE | 197 38 735 | 3/1999 |
| EP | 0 999 302 | 5/2000 |
| EP | 2692940 | 2/2005 |
| EP | 1 820 893 | 8/2007 |
| EP | 2147999 | 1/2010 |
| EP | 2 551 401 | 1/2013 |
| EP | 2 573 252 | 3/2013 |
| EP | 2 628 844 | 8/2013 |
| FR | 2 347 087 | 11/1977 |
| GB | 1 363 292 | 8/1974 |
| JP | 2011-092510 | 5/2011 |
| KR | 10-2009-0117975 | 11/2009 |
| KR | 10-1235552 | 2/2013 |
| KR | 10-2014-0107984 | 9/2014 |
| WO | WO 2007/073052 | 6/2007 |
| WO | WO 2009/059889 | 5/2009 |
| WO | WO 2009/106150 | 9/2009 |
| WO | WO 2011/080116 | 7/2011 |
| WO | WO 2011/088116 | 7/2011 |
| WO | WO 2013/045363 | 4/2013 |
| WO | WO 2014/076159 | 5/2014 |
| WO | WO 2014/082999 | 6/2014 |
| WO | WO 2014/133247 | 9/2014 |

OTHER PUBLICATIONS

European Search Report dated May 9, 2016.
Australian Office Action dated Jul. 14, 2016 issued in Application No. 2015282373.
Russian Office Action dated Dec. 26, 2014 issued in Application No. 2013142950 (with English Translation).
Russian Notice of Allowance dated Mar. 25, 2015 issued in Application No. 2013142950 (with English Translation).
Australian Examination Report dated Mar. 26, 2015 issued in Application No. 2013245540.
U.S. Office Action dated Jun. 3, 2015 issued in U.S. Appl. No. 14/057,226, now U.S. Pat. No. 9,207,015.
U.S. Notice of Allowance dated Oct. 15, 2015 issued in U.S. Appl. No. 14/057,226, now U.S. Pat. No. 9,207,015.
Partial English Machine Translation of DE 4 409 607 accessed Jun. 23, 2016.
Chinese Office Action dated Jul. 23, 2015 issued in Application No. 201310492621.1 (with English translation).
U.S. Office Action dated Jul. 14, 2016 issued in U.S. Appl. No. 14/057,212.
European Search Report dated Feb. 26, 2016 issued in Application No. 13189245.7.
U.S. Office Action dated Jan. 12, 2017 issued in U.S. Appl. No. 14/057,212.
Chinese Office Action dated Jun. 30, 2017 issued in Application No. 201511001458.X (with English translation).

* cited by examiner

CLOTHES TREATING APPARATUS

CROSS-REFERENCE TO RELATED APPLICATIONS

Pursuant to 35 U.S.C. §119(a), this application claims of priority to Korean Application No. 10-2014-0192542, filed in Korea on Dec. 29, 2014, the content of which is incorporated by reference herein in its entirety.

BACKGROUND

1. Field

A clothes treating apparatus, and more particularly, a clothes treating apparatus having a heat pump cycle for drying clothes is disclosed herein.

2. Background

Generally, clothes dryer having a drying function, such as a washing machine or a dryer, is an apparatus that dries laundry by evaporating moisture contained in the laundry, by blowing a hot blast generated by a heater into a drum. The clothes dryer may be classified into an exhausting type clothes dryer or a condensing type clothes dryer according to a processing method of humid air having passed through a drum after drying laundry.

In the exhausting type clothes dryer, humid air having passed through a drum is exhausted outside of the clothes dryer. On the other hand, in the condensing type clothes dryer, humid air having passed through a drum is circulated without being exhausted outside of the clothes dryer. Then, the humid air is cooled to a temperature less than a dew-point temperature by a condenser, so moisture included in the humid air is condensed.

In the condensing type clothes dryer, condensate water condensed by a condenser is heated by a heater, and then heated air is introduced into a drum. While humid air is cooled to be condensed, thermal energy of the air is lost. In order to heat the air to a temperature high enough to dry laundry, an additional heater is required.

In the exhausting type clothes dryer, air of high temperature and high humidity should be exhausted outside of the clothes dryer, and external air at room temperature should be introduced to be heated to a required temperature by a heater. As drying processes are executed, air discharged from an outlet of the drum has low humidity. This air is not used to dry laundry, but rather, is exhausted outside of the clothes dryer. As a result, a heat quantity of the air is lost. This may degrade thermal efficiency.

Recently, a clothes dryer having a heat pump cycle, capable of enhancing energy efficiency by collecting energy discharged from a drum and by heating air introduced into the drum using the energy, has been developed. Such a condensing type clothes dryer may include a drum, into which laundry may be introduced, a circulation duct that provides a passage such that air circulates via the drum, a circulation fan configured to move circulating air along the circulation duct, and a heat pump cycle having an evaporator and a condenser serially installed along the circulation duct, such that air circulating along the circulation duct passes through the evaporator and the condenser. The heat pump cycle may include a circulation pipe, which forms the circulation passage, such that a refrigerant circulates via the evaporator and the condense, and a compressor and an expansion valve installed along the circulation pipe between the evaporator and the condenser.

In the heat pump cycle, thermal energy of air having passed through the drum may be transferred to a refrigerant via the evaporator, and then the thermal energy of the refrigerant may be transferred to air introduced into the drum via the condenser. With such a configuration, a hot blast may be generated using thermal energy discarded by the conventional exhausting type clothes dryer or lost in the conventional condensing type clothes dryer. In this case, a heater for heating air heated while passing through the condenser may be additionally included. The clothes dryer using the heat pump cycle may have a more effective dehumidifying function via a drying method using a heat pump cycle, rather than by the conventional method, due to its high energy efficiency.

BRIEF DESCRIPTION OF THE DRAWINGS

Embodiments will be described in detail with reference to the following drawings in which like reference numerals refer to like elements, and wherein.

DETAILED DESCRIPTION

Description will now be given of embodiments of a clothes treating apparatus, with reference to the accompanying drawings. For the sake of brief description with reference to the drawings, the same or like components will be provided with the same or like reference numbers, and description thereof will not be repeated. A singular expression in the specification may include a plural meaning unless it is contextually definitely represented.

In embodiments, a clothes treating apparatus is implemented as a condensing type clothes dryer capable of drying an object to be dried, such as wet clothes, in an air circulating manner. However, embodiments are not limited to this. For instance, the clothes treating apparatus according to embodiments may be another type of clothes dryer, such as washing machine having a drying function, for example.

Figure 1:
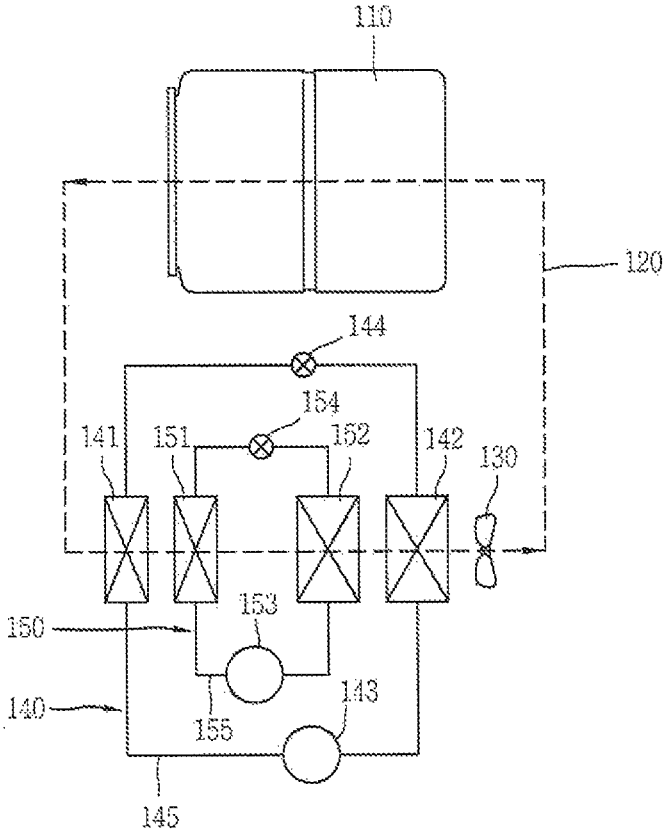
FIG. 1 is a schematic diagram of a clothes treating apparatus having a heat pump cycle according to an embodiment.
Figure 2:
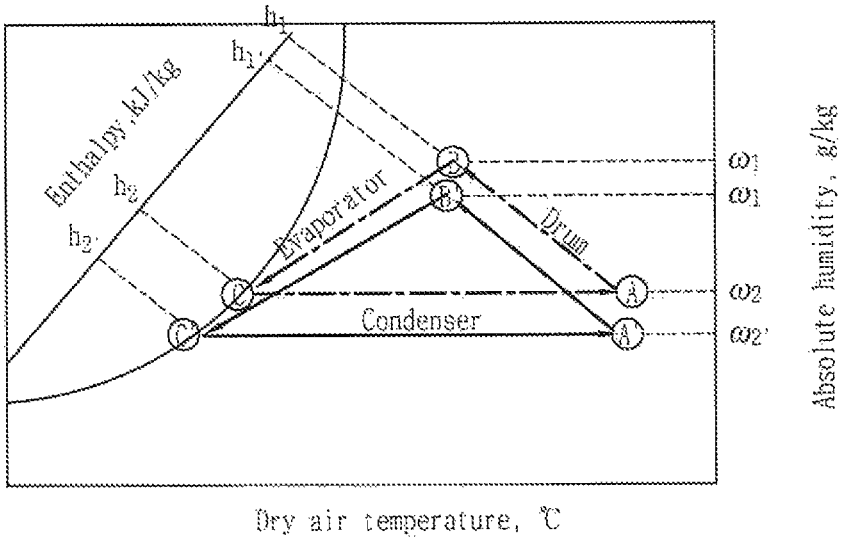
FIG. 2 is a psychometric chart of air used to perform a drying process the clothes treating apparatus of FIG. 1.
Figure 3:
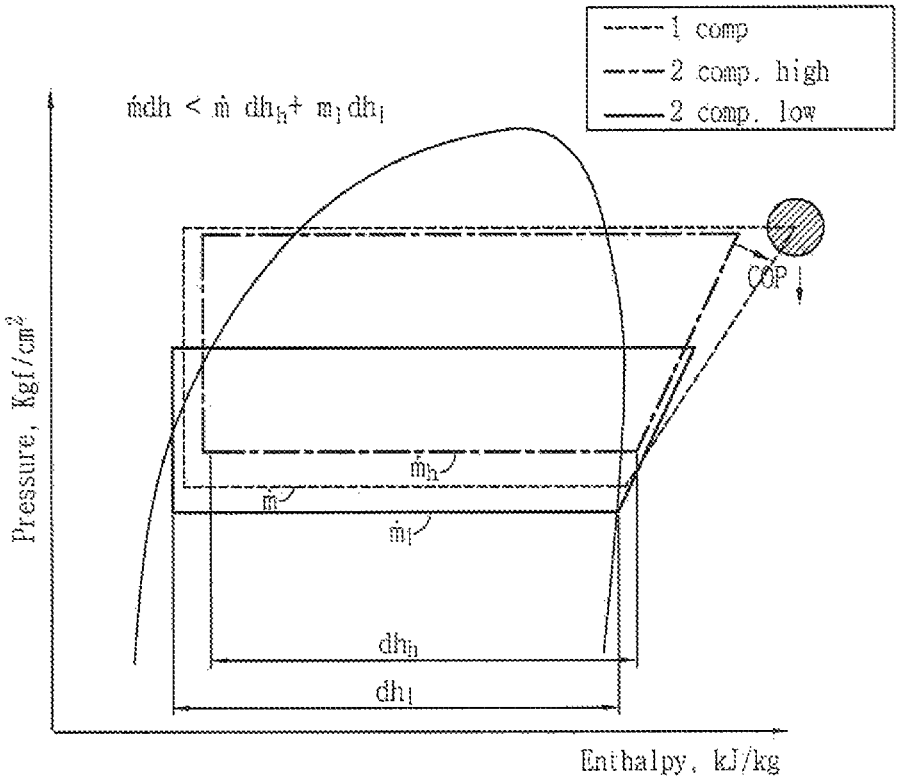
FIG. 3 is a moliere chart (PH chart) of air used to perform a drying process in the clothes treating apparatus of FIG. 1.
Figure 4:
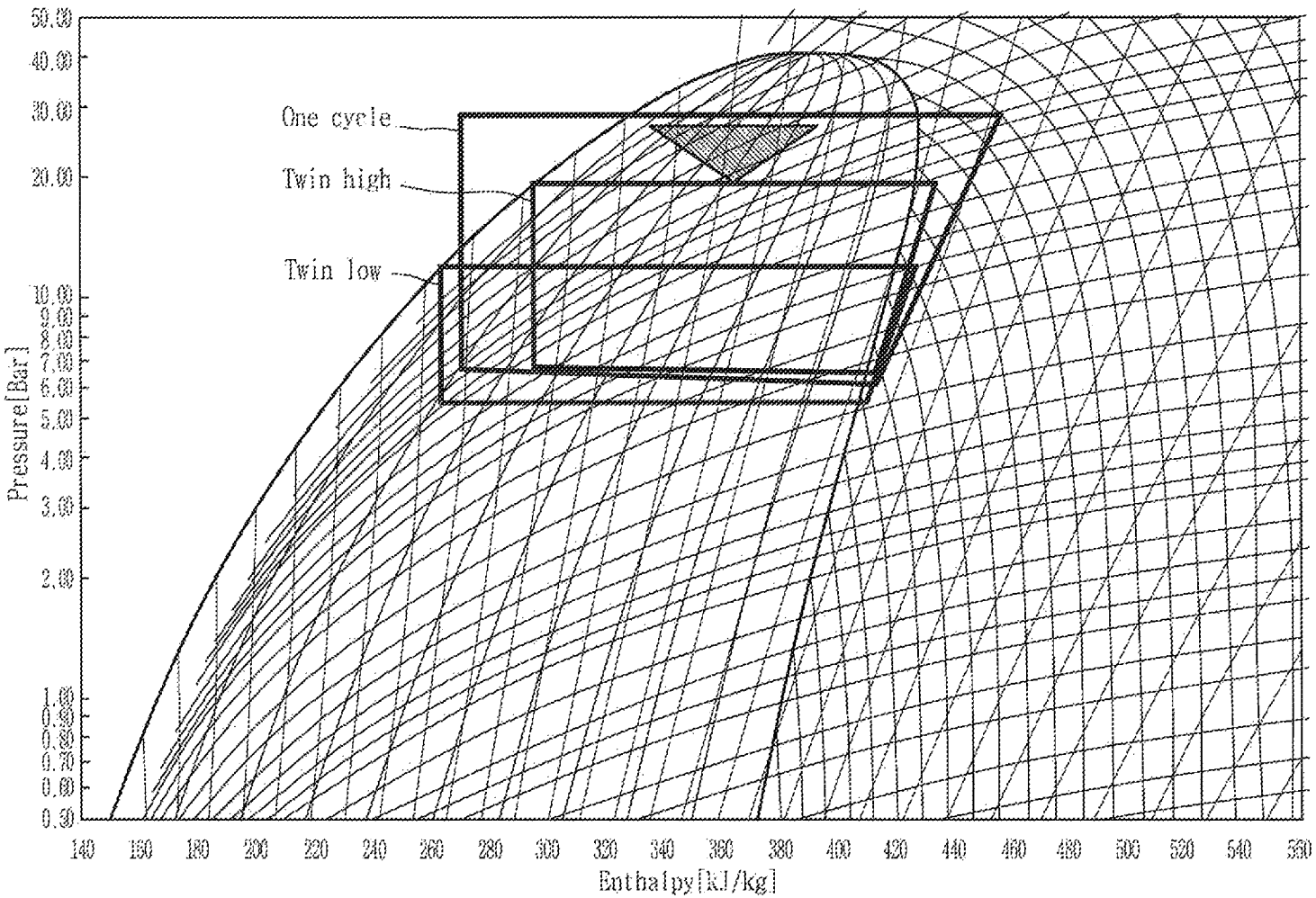
FIG. 4 is a moliere chart (PH chart) comparing a single heat pump cycle with a multi-heat pump cycle in a case of a same it volume.

FIG. 1 is a schematic diagram of a clothes treating apparatus having a heat pump cycle according to an embodiment. FIG. 2 is a psychometric chart of air used to perform a drying, process in the clothes treating apparatus of FIG. 1. FIG. 3 moliere chart (PH chart) of air used to perform a drying process in the clothes treating apparatus of FIG. 1 FIG. 4 is a moliere chart (PH chart) comparing a single heat pump cycle with a multi-heat pump cycle in a case of a same air volume.

As shown the clothes treating apparatus according to an embodiment may include a case (not shown), a drum 110, a circulation duct 120, a circulation fan 130, heat pump cycles 140, 150, and a controller (not shown). The case may form an outer appearance of the clothes treating apparatus, and a user input and a display, for example, may be provided on or at an upper end of the case. A user may select various modes having various functions through the user input, during a washing process, and the user may check a current state of the clothes treating apparatus through the display.

An object to be washed and an object to be dried may be accommodated in the drum 110. Accordingly, the drum 110 may be referred to as an "accommodating chamber". The drum 110 may have a cylindrical shape having an accommodating space to accommodate an object therein. The drum 110 may be rotatably installed in the case. A front side of the drum 110 may be open, and an opening may be formed at a front side of the case. The object may be accommodated in the drum 110 through the opening of the case and the front side of the drum 110. The drum 110 may be installed, such that a rotational shaft thereof may be horizontally positioned in the case. The drum 110 may be driven by a drive motor installed below the case. An output shaft of the drive motor may be connected to an outer circumferential surface of the drum 110 by, for example, a belt. As a rotational force of the drive motor is transmitted to the drum 110 through the belt the drum 110 may be rotated.

The object may be dried by heated air which may circulate via the drum 110. The heated air may circulate along the circulation duct 120. The circulation duct 120 may form a circulation path, such that air may circulate via the drum 110. As at least a portion of the circulation duct 120 may communicate with an outlet formed at the front side of the drum 110, air discharged from the outlet of the drum 110 may be introduced into the circulation duct 120. As at least another portion of the circulation duct 120 may communicate with an inlet formed at a rear side of the drum 110, air inside of the circulation duct 120 may be supplied to the in et of the drum 110.

The air inside of the circulation duct 120 may move along the circulation duct 120, by receiving a circulation drive force from the circulation fan 130. One or more circulation fans 130 may be installed in the circulation duct 120, and the air inside of the circulation duct 120 may be introduced into the drum 110 as the circulation fan 130 is operated. The air having passed through the drum 110 may move along the circulation duct 120, and may be introduced into the inlet of the drum 110 in a circulating manner. The circulation fan 130 may be connected to the drive motor, and may be driven by receiving a drive farce from the drive motor.

As shown, the circulating air may be heated by a plurality of heat pump cycles. The plurality of heat pump cycles may include a first heat pump cycle 140 and a second heat pump cycle 150. However embodiments are not limited thereto. For example, more than two, or three heat pump cycles may be provided to execute a control method, which is discussed hereinafter.

The first and second heat pump cycles 140, 150 may absorb heat from a low temperature region and radiate she absorbed heat to a high temperature region, thereby transferring the heat of the low temperature region to the high temperature region. In this case, the circulating air may be heated at the high temperature region.

The first pump cycle 140 may include a first evaporator 141, a first compressor 143, a first condenser 142, and a first expansion valve 144. The first evaporator 141 may be provided at the low temperature region to absorb heat, and the first condenser 142 may be provided at the high temperature region to radiate heat. For example, the first evaporator 141 may be installed in the circulation duct 120 connected to the outlet of the drum 110. The first condenser 142 may be installed in the circulation duct 120 connected to the inlet of the drum 110. The first evaporator 141 and the first condenser 142 may be spaced from each other in the circulation duct 120. Based on an air flow direction, the first evaporator 141 may be installed at an upstream side of the circulation duct 120, and the first condenser 142 may be installed at a downstream side of the circulation duct 120.

A moving path of heated air along the circulation duct 120 will be discussed hereinafter. Once the circulation fan 130 is operated, heated dry air inside of the circulation duct 120 may be introduced into the inlet of the drum 110 to dry an object, such as laundry, accommodated in the drum 110. Then, the air may be discharged from the drum 110. The humid air discharged from the drum 110 may pass through the first evaporator 141 and then may be re-introduced into the drum 110 via the first condenser 142. In this case, air discharged from the drum 110, for example, air having a temperature of about 40° C., may have its heat removed by the first evaporator 141, and be heated at the first condenser 142. Then, the air may introduced into the drum 110. The air having passed through the drum 110 may be cooled, condensed and dehumidified by the first evaporator 141. The air having passed through the first evaporator 141 may be heated by the first condenser 142.

The first evaporator 141 may be various types, including a plate type, a printed circuit board type, or a fin-tube type, for example. The first evaporator 141 shown in FIG. 2 may be a fin-tube type, for example.

A fin-tube type heat exchanger may include a plurality of heat exchange fins formed as a plate type, and a plurality of heat exchange pipes that penetrate the plurality of heat exchange fins in a horizontal direction. The plurality of heat exchange pipes may be connected to each other by a connection pipe bent in a semi-circular shape, and an operation fluid may flow in the plurality of heat exchange pipes. The plurality of heat exchange fins may be provided in the circulation duct 120 in a vertical direction, and may be spaced from each other in a direction that crosses an air flow direction. With such a configuration, air discharged from the drum 110 may contact the plurality of heat exchange fins and the plurality of heat exchange pipes while passing through an air passage between the plurality of heat exchange fins. Accordingly, the operation fluid may be heat-exchanged with the air. The plurality of heat exchange fins may be connected to the plurality of heat exchange pipes so as to increase a contact area between the plurality of heat exchange pipes and air. The operation fluid may be a refrigerant, for example.

As discussed above, the first condenser 142 may be a fin-tube type heat exchanger, and detailed explanations thereof has been omitted. Heat of air having passed through the drum 110 may be transferred to be absorbed by a refrigerant of the first evaporator 141, and heat of a refrigerant of the first condenser 142 may be transferred to radiate to air having passed through the first evaporator 141. The first evaporator 141, the first condenser 142, and the first expansion valve 144 may be connected to each other by a first circulation pipe 145. The first circulation pipe 145 may form a closed loop.

A moving path of a refrigerant flowing along the first circulation pipe 145 will be discussed hereinafter. The refrigerant may pass through the first evaporator 141, the first compressor 143, the first condenser 142, and the first expansion valve 144. Then, the refrigerant may be re-introduced into the first evaporator 141.

The first evaporator 141 may absorb heat from air having passed through the drum 110 and transfer the absorbed heat to a refrigerant of the plurality of heat exchange pipes. Accordingly, a liquid refrigerant of low temperature and low pressure, introduced into the first evaporator 141, may be converted into a gaseous refrigerant of low temperature and low pressure. Air passing through the evaporator may be cooled by latent heat of gasification due to a state change of the refrigerant at the first evaporator 141, thereby being condensed and dehumidified. The gaseous refrigerant of low temperature and low pressure, discharged from the first evaporator 141, may flow along the first circulation pipe 145, and may be introduced into the first compressor 143.

The first compressor 143 may compress a gaseous refrigerant of low temperature and low pressure, and form a gaseous refrigerant of high temperature and high pressure. Accordingly, it is possible to radiate heat absorbed at the low temperature region, from the high temperature region.

The gaseous refrigerant of high temperature and high pressure, discharged from the first compressor 143, may slow along the first circulation pipe 145, and may be introduced into the first condenser 142. As the first condenser 142 transfers and radiates heat of the gaseous refrigerant of high temperature and high pressure to air discharged from the first evaporator 141, the gaseous refrigerant of high temperature and high pressure may be converted into a liquid refrigerant of high temperature and high pressure. Condensation latent heat, due to a state change of the refrigerant at the first condenser 142, may be used to heat air passing through the first condenser 142.

The liquid refrigerant of high temperature and high pressure, discharged from the first condenser 142, may flow along the first circulation pipe 145, and may be introduced into the first expansion valve 144. The first expansion valve 144 may expand a liquid refrigerant of high temperature and high pressure, and form a liquid refrigerant of low temperature and low pressure. Accordingly, it is possible to absorb heat from air having passed through the drum 110.

The liquid refrigerant of low temperature and low pressure, discharged from the first expansion valve 144, may flow along the first circulation pipe 145, and may be re-introduced into the first evaporator 141. In this case, the liquid refrigerant of low temperature and low pressure may be partially converted into a gaseous refrigerant of low temperature and low pressure, while moving along the first circulation pipe 145. Accordingly, a refrigerant of low temperature and low pressure, introduced into the first evaporator 141, may be in a mixed state between a gaseous state and a liquid state.

A different type of evaporator and condenser may be provided between the first evaporator 141 and the first condenser 142. For example, the second heat pump cycle 150 may be provided with a second evaporator 151, a second compressor 153, a second condenser 152, and a second expansion valve 154. The second evaporator 151 and the second condenser 52 may be arranged such that air introduced into the accommodating chamber may pass through the first evaporator 141, the second evaporator 151, the second condenser 152, and the first condenser 142, sequentially. In this case, the second evaporator 151, the second compressor 153, the second condenser 152, and the second expansion valve 154 may have the same functions as the first evaporator 141, the first compressor 143, the first condenser 142 and the first expansion valve 144 and thus, detailed description thereof has been omitted.

A refrigerant of the second heat pump cycle 150 may be the same as or different from a refrigerant of the first heat pump cycle 140. If the refrigerant of the second heat pump cycle 150 is different from the refrigerant of the first heat pump cycle 140, the refrigerants of the first and second heat pump cycles may be hetero-type refrigerants with consideration of temperature pressure, a high ratio of latent heat, and price, for example.

The second evaporator 151, the second compressor 153, the second condenser 152, and the second expansion valve 154 may be connected to each other by a second circulation pipe 155 and the second circulation pipe 155 may form a closed loop. With such a configuration, the second evaporator 151 may remove moisture from circulating air, and the second condenser 152 may heat air introduced into the drum 110.

An operation of the first and second heat pump cycles 140, 150 may be controlled by the controller, and each of the first and second heat pump cycles 140, 150 may be operated as an independent multi-heat pump cycle. Accordingly, wet vapor, evaporated from an object to be washed and dried inside of the drum 110, may be dehumidified through the first and second evaporators 141, 151. During this process, sensible heat and latent heat collected from the first and second evaporators 141, 151 may be converted into heat of high temperature and high pressure, by the first and second compressors 143, 153. Then the heat may be radiated through the first and second condensers 142, 152, and may be used to dry the object inside of the drum 110. In this case, the first heat pump cycle 140 may be a high pressure side cycle, and the second heat pump cycle 150 may be a low pressure side cycle.

More specifically, as shown, wet vapor evaporated from the drum 110 may firstly contact the first evaporator 141 of the first heat pump cycle 140, an outer independent cycle, before contacting the second evaporator 151 of the second heat pump cycle 50, an inner independent cycle. During such a dehumidifying process, an enthalpy of the wet vapor may be lowered. The wet vapor deprived of sensible heat and latent heat has its temperature-humidity lowered, and requires a lower evaporation temperature for more effective dehumidification. The wet vapor increases dehumidifying amount per hour while passing through the second evaporator 151 of the second heat pump cycle 150, the second evaporator 151 having a relatively lower evaporation temperature. Consequently, the wet vapor may be in a state of reducing a drying time.

The second evaporator 151 has a lower evaporation pressure (evaporation temperature) than the first evaporator 141 having a relatively higher pressure. The reason is because the enthalpy of the wet vapor having passed through the first evaporator 141 is lowered. As a result, a condensation pressure (condensation temperature) is lowered. Air, which has been firstly heated by the second condenser 152, may be heated to a higher temperature by the first condenser 142 having a relatively higher condensation pressure (condensation temperature). When compared with a single heat pump cycle, in the multi-heat pump cycle, evaporation efficiency is more enhanced as air passing through two evaporators has a larger amount of dehumidification, and drier air may be introduced into the drum after being heated to a high temperature.

Referring to FIG. 2, wet air in a dry state (A), introduced into the drum through the condenser, has low temperature and high humidity through a constant enthalpy change when it reaches a stable dry state. In state (B) of low temperature and high humidify, the wet air is discharged from the outlet of the drum. When compared with the single heat pump cycle indicated by the dotted line, the multi-heat pump cycle indicated by the solid line may produce a larger cooling capacity with respect to a same input as shown in the following formula 1, and a more enhanced dehumidification capability as shown in the following formula 2. As a result, not only a drying energy but also a drying time may be reduced.

$$\dot{m}_{da}(h_1'-h_2')>\dot{m}_{da}(h_1-h_2) \quad \text{[Formula 1]}$$

where, $\dot{m}_{da}$: Mass flow of dry air $$\dot{m}_{da}(w_1'-w_2')>\dot{m}_{da}(w_1-w_2) \quad \text{[Formula 2]}$$

FIG. 3 is a graph comparing a refrigerant side of the first heat pump cycle 140 with a refrigerant side of the second heat pump cycle 150. The dotted line indicates a moliere chart (PH chart) when a drying time is shortened by increasing a cooling capacity to a maximum by increasing a capacity of the compressor, in the single heat pump cycle. Referring to FIG. 3, a discharge pressure of the compressor is increased as a cooling capacity is increased to a maximum, and driving efficiency is drastically lowered as a pressure ratio is increased. On the other hand, the multi-heat pump cycle is independently driven by two evaporation temperatures and two condensation temperatures. The evaporator is configured such that a low pressure evaporator subsequent to a high pressure evaporator has a lower temperature than in a single heat pump cycle for effective dehumidification. Also, in the evaporator, a cycle is divided to lower a pressure ratio of each compressor and to crease a coefficient of performance. This may result in a shorter drying time and a high-efficiency driving.

In this case, as a drastic increase of a discharge temperature at a discharge side of the compressor is prevented, the compressor may have high reliability. Also, the compressor may be driven with a margin with respect to a winding temperature limiting line of a motor due to the increase in the discharge temperature.

For a similar cooling capacity, a compression ratio may be formed to be largest at the single heat pump cycle, but to be very small at a lower pressure side (second heat pump cycle) of the multi-heat pump cycle. The higher the compression ratio is, the lower the efficiency of the compressor is. Accordingly, the cycles may be operated by properly-divided compression ratios, for low power consumption with an increased cooling capacity (a reduced drying time).

Referring to FIG. 4, based on an assumption that drying performance is similar under a same air volume of an operation fluid, a high pressure side and a low pressure side of a system having the multi-heat pump cycle are shown at a lower region of the PH chart than that of a system having the single heat pump cycle. As a result, a temperature of air inside a closed flow path system of the clothes treating apparatus is lowered. This results in lowering of temperature of dry air introduced into the drum after being heated by the condenser. Accordingly, an object to be dried may be dried to or at a lower temperature than in the single heat pump cycle.

As shown, pressure lowering of a refrigerant at the evaporator side of the single heat pump cycle is larger than pressure lowering at the evaporator side of the multi-heat pump cycle. This results because a large amount of refrigerant may flow in a single evaporator. If the multi-heat pump cycle is independently driven, a refrigerant flows to each cycle in a diverged manner. This may reduce a refrigerant circulation amount per cycle, thereby reducing a pressure loss of a refrigerant at the evaporator side. This is related to increase of a cooling capacity, which is advantageous in maintaining a high suction pressure of the compressor, and reducing a compression ratio.

More specifically, in a case of the single heat pump cycle, air introduced into the inlet of the drum via the condenser having a condensation temperature of about 84° C. has a temperature more than about 80° C. On the other hand, in a case of the multi-heat pump cycle, air introduced into the inlet of the drum via the low pressure side condenser (condensation temperature: about 47° C. and the high pressure side condenser (condensation temperature: about 66° C.) has a temperature less than about 66° C. In the two cases, a difference between the air temperatures is about 15° C. This may cause a difference in damage to clothes.

As shown in FIG. 2, a psychometric chart of a multi-heat pump cycle is more inclined to the left lower side than that of a single heat pump cycle. As a change of dw (absolute humidity difference) or a change of Qe (index of a cooling capacity) scarcely occurs, a drying time may be the same. If necessary, the degree of laundry damage due to temperature and friction may be determined in a synthesized manner, by increasing a cooling capacity by narrowing the temperature difference of 15° C. (t3−t'3), by lowering a temperature to a proper level, and by shortening a drying time.

Further, the clothes treating apparatus according to an embodiment may be provided with an inverter (not shown) configured to change a drive speed of one of the first compressor 143 or the second compressor 153 through a frequency conversion or a frequency shift. In this case, the controller may control a drive speed of at least one of the first compressor 43 or the second compressor 153 using the inverter, thereby operating at least one of the first compressor 143 or the second compressor 153 within a preset or predetermined drive range. With such a configuration, the clothes treating apparatus according to an embodiment may maintain the cycles within an operation region, despite a change in a peripheral temperature, an amount of the object (drying load), or an amount of initial moisture contained (NC) in the object. Hereinafter, such a structure and function will be discussed with reference to FIGS. 5 to 9.

Figure 5:
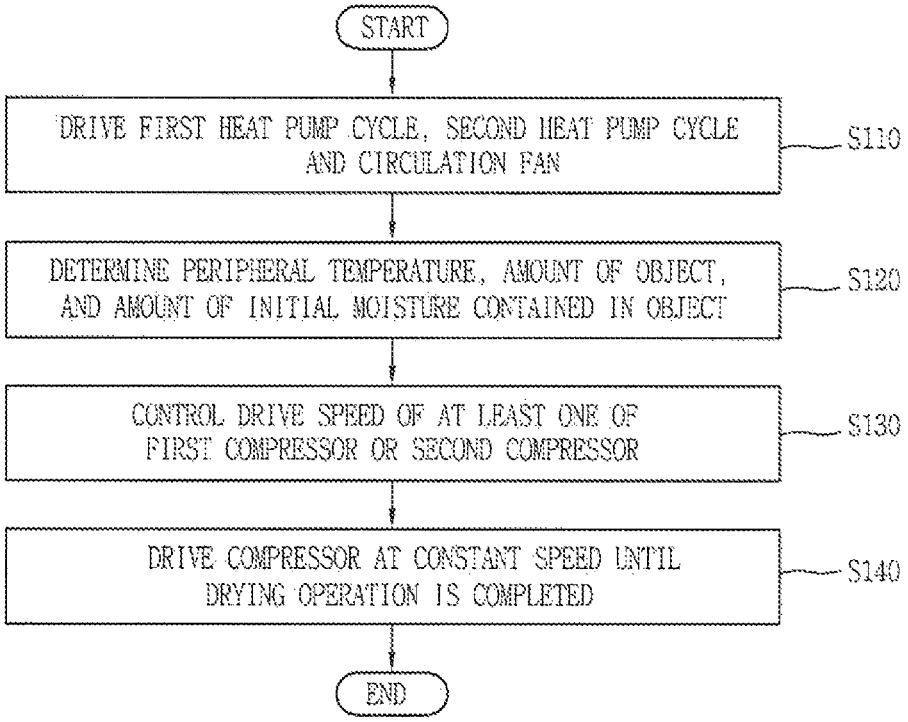
FIG. 5 is a flowchart of a method for controlling a drying process of the clothes treating apparatus of FIG. 1.
Figure 6:
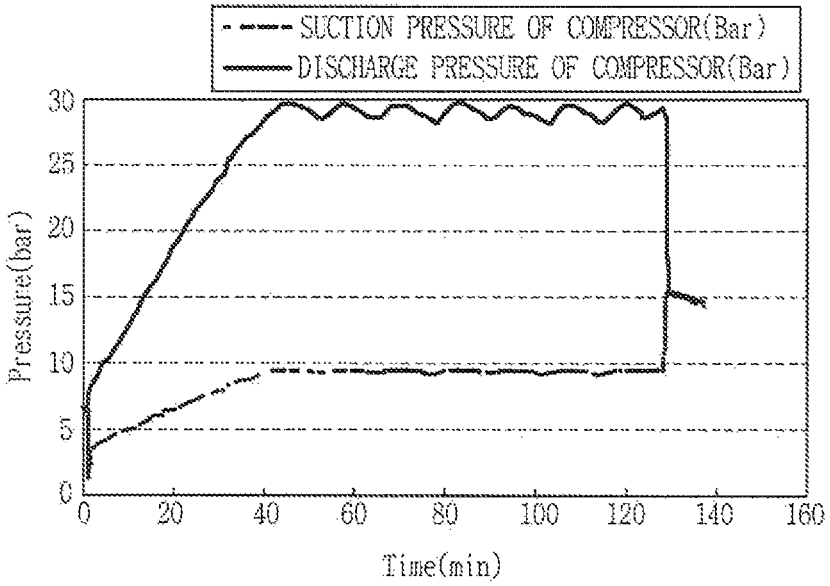
FIG. 6 is a graph illustrating that a high pressure side heat pump cycle reaches a limiting point (reliable compressor driving region)
Figure 7A:
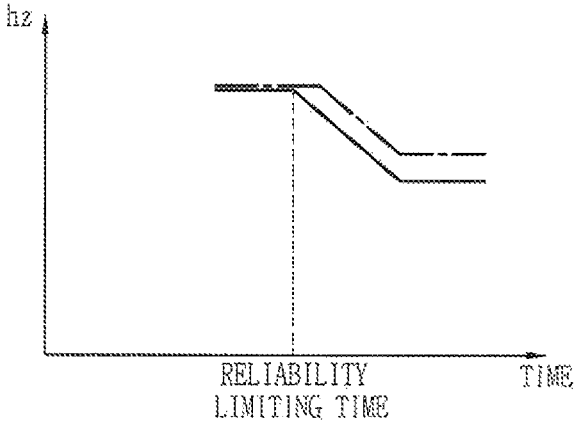
FIGS. 7A to 7C are graphs illustrating a method for controlling a reliable, compressor driving region under a first condition in the method of FIG. 5.
Figure 7B:
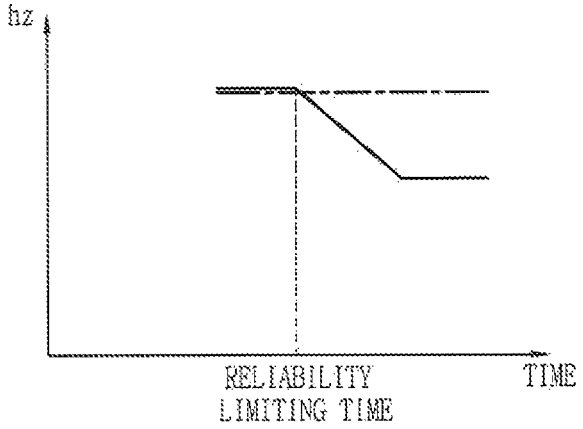
Figure 7C:
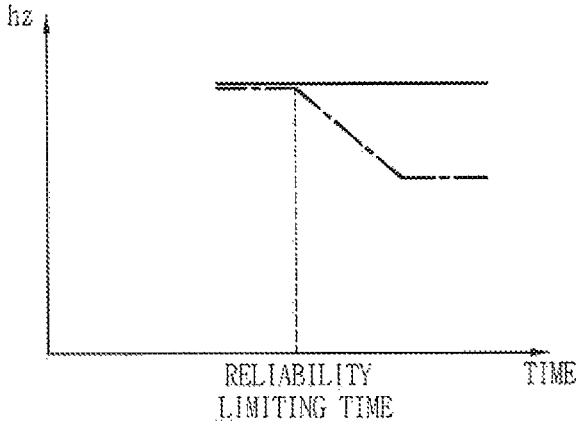
Figure 8A:
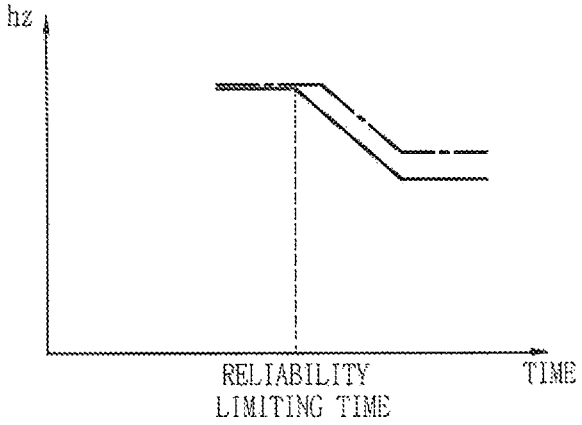
FIGS. 8A to 8C are graphs illustrating a method for controlling a reliable compressor driving region under a second condition in the method of FIG. 5.
Figure 8B:
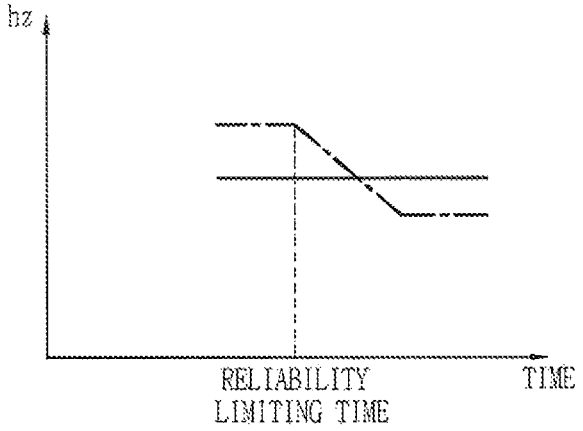
Figure 8C:
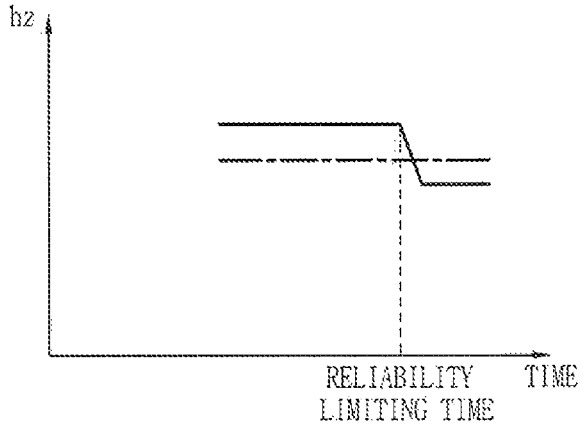
Figure 9:
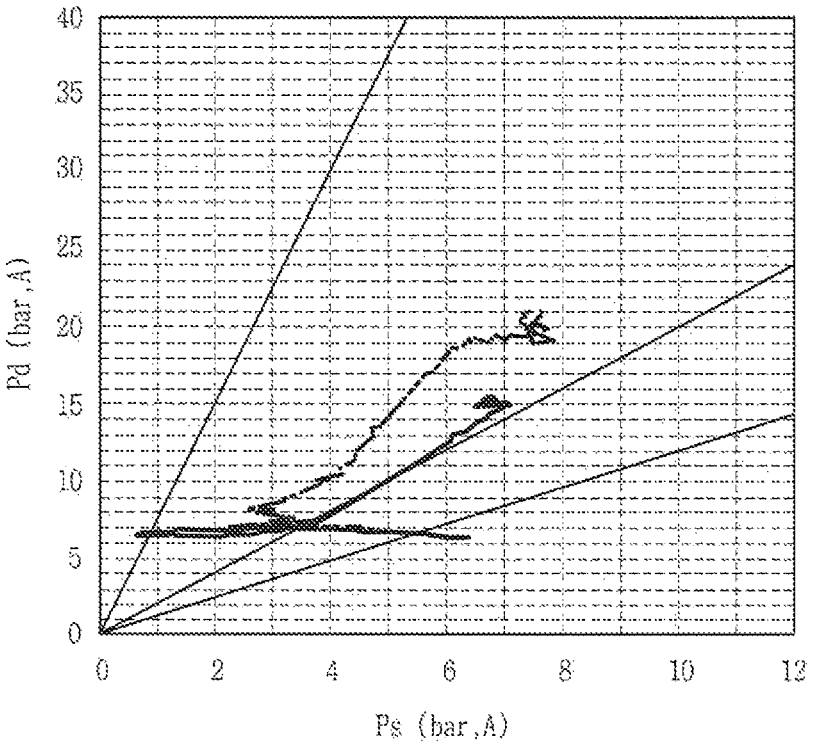
FIG. 9 is a graph illustrating a discharge pressure of a compressor having inverter, with respect to a suction pressure when an external load is low.

FIG. 5 is a flowchart of a method for controlling a drying process of the clothes treating apparatus of FIG. 1. FIG. 6 is a graph illustrating that a high pressure side heat pump cycle reaches a limiting point (reliable compressor driving region). FIGS. 7A to 7C are graphs illustrating a method for a reliable compressor driving region under a first condition in the method of FIG. 5. FIGS. 8A to 8C are graphs illustrating a method for a reliable compressor driving region under a second condition in the method of FIG. 5. FIG. 9 is a graph illustrating a discharge pressure of a compressor having an inverter, with respect to a suction pressure when an external load is low.

Referring to FIG. 5, a method used for controlling a drying process of the clothes treating apparatus of FIG. 1 may include driving the first heat pump cycle 140, the second heat pump cycle 150, and the circulation fan 130 (refer to FIG. 1) to dry an object (S110). In this case, circulation air, having passed through the drum 110, may be circulated in the circulation duct 120 by the circulation fan 130. Then, the circulation air may pass through the first evaporator 141, the second evaporator 151 the second condenser 162, and the first condenser 142. The circulation air may be cooled by being deprived of heat by the first and second evaporators 141, 152. Then, the cooled air may be heated while passing through the second condenser 152 and the first condenser 142.

Before the drying process, a process of pre-heating the drum 110, and the circulation duct 120, for example, may be performed using only a heating effect of at least one of the first condenser 142 and the second condenser 152. For example, in order to effectively use heat discharged from at least one of the first condenser 142 or the second condenser 152, air discharged from the drum 110 during a washing process and a dehydrating process may bypass the first evaporator 141 and the second evaporator 151 to thus be introduced into at least one of the first condenser 142 or the second condenser 152. As the air having passed through the drum 110 is introduced into at least one of the first condenser 142 or the second condenser 152 to thus be heated, without being cooled by the first and second evaporators 141, 151, a heating effect of the condenser may be maximized. In order to use one of the first condenser 142 or the second condenser 152 or both of the first and second condensers 142, 152 during a pre-heating process, one of the first heat pump cycle 140 or the second heat pump cycle 150 may be driven, or both of the first and second heat pump cycles 140, 150 may be driven.

Referring again to FIG. 5, after the first heat pump cycle 140, the second heat pump cycle 150, and the circulation fan 130 are driven, a peripheral temperature, an amount of the object, or an amount of initial moisture contained (IMC) in the object may be determined by a sensor mounted at a preset or predetermined position (S120). For example, a temperature sensor may be provided on at least one of the first heat pump cycle 140 or the second heat pump cycle 150. The controller may determine the peripheral temperature, the amount of the object, or the amount of initial moisture contained (IMC) in the object, based on a temperature measured by the temperature sensor. The temperature measured by the temperature sensor may be a condensation temperature of the condenser or a discharge temperature of the compressor for example. The controller may sense, using the sensor, whether one of condensation temperatures of the first and second condensers 142, 152 is out of a preset or predetermined range, or whether one of discharge temperatures of the first and second compressors 143, 153 is out of a preset or predetermined range.

In this case, if the condensation temperature of the condenser or the discharge temperature of the compressor is out of the preset or predetermined range, the controller may determine that at least one of the peripheral temperature, the amount of the object, or the amount of initial moisture contained (NC) in the object is out of a specific range. For example, when the peripheral temperature is higher thane preset or predetermined temperature, when the amount of the object is larger than a preset or predetermined amount, or when the amount of initial moisture contained (IMC) in the object is larger than a preset or predetermined amount, the first heat pump cycle 140, a high pressure side heat pump cycle, may reach a limiting point at a faster speed. In this case, the condensation temperature of the first condenser 142 or the discharge temperature of the first compressor 143 may be out of a preset or predetermined range. Thus, the controller may sense whether at least one of the peripheral temperature, the amount of the object, and the amount of initial moisture contained (IMC) in the object is out of an upper limit value within a preset or predetermined range, using the condensation temperature of the first condenser 142 or the discharge temperature of the first compressor 143.

On the contrary, when the peripheral temperature is lower than a preset or predetermined temperature, when the amount of the object is smaller than a preset or predetermined amount, or when the amount of initial moisture contained (IMC) in the object is smaller than a preset or predetermined amount, both the first heat pump cycle 140 and the second heat pump cycle 150 may have reduced performance. Such reduced performance may be also sensed based on the condensation temperature of the condenser or the discharge temperature of the compressor. The condensation temperature of the condense the discharge temperature of the compressor, which causes reduced performance, may be set to have a specific value or a specific range through experiments.

As another example, whether the peripheral temperature is high or low may be sensed by the temperature sensor before the first heat pump cycle 140 the second heat pump cycle 150, and the circulation fan 130 are driven. In this case, the driving (S110) may be omitted. In the determination (S120), a degree of the peripheral temperature may be determined before the first heat pump cycle 140, the second heat pump cycle 150, and the circulation fan 130 are driven.

As still another example, whether the amount of the object is larger or smaller than a preset or predetermined amount may be sensed before the first heat pump cycle 140, the second heat pump cycle 150 and the circulation fan 130 are driven. As the amount of the object inside of the drum may be measured by a weight sensor, for example, the driving (S110) may be omitted. In the determination (S120), the degree of the amount of the object may be determined before the first heat pump cycle 140, the second heat pump cycle 150, and the circulation fan 130 are driven.

As shown, after the determination (S120), the compressor may be controlled (S130). For example, when at least one of the peripheral temperature, the amount of the object, and the amount of initial moisture contained (IMC) in the object is out of a preset or predetermined range, the controller may control a drive speed of at least one of the first compressor 143 or the second compressor 153 (refer to FIG. 1) (S130).

For the control of the drive speed, at least one of the first compressor 143 or the second compressor 153 may be provided with an inverter that changes a drive speed of the compressor through a frequency conversion. The controller may drive at least one of the first compressor 143 or the second compressor 153 within a preset or predetermined drive range, by controlling a drive speed of at least one of the first compressor 143 or and the second compressor 153. In this case, the preset or predetermined drive range may indicate a compression ratio range, and the second compressor 153 may be formed to have a larger compression ratio than the first compressor 143.

More specifically, referring to FIGS. 6 to 9, at least one of the first compressor 143 or the second compressor 153 may be driven in a first mode in which the drive speed is constant as a first speed, and a second mode, in which the drive speed is varied from the first speed to a second speed. The constant drive speed corresponding to the first speed may be changed into another speed corresponding to the second speed. In this case, when at least one of the peripheral temperature, the amount of the object, and the amount of initial moisture contained (IMC) in the object is out of a preset or predetermined range, the controller may control at least one of the first compressor 43 or the second compressor 153 to be driven in the second mode.

As discussed above, the peripheral temperature, the amount of the object, or the amount of initial moisture contained (IMC) in the object may be determined based on a condensation temperature of the condenser or a discharge temperature of the compressor sensed by at least one of the first heat pump cycle or the second heat pump cycle. Thus, the controller may control a drive speed of at least one of the first compressor or the second compressor, based on the sensed condensation temperature or the sensed discharge temperature. As discussed above, if the peripheral temperature or the amount of the object is determined by a temperature sensor or a weight sensor, a drive speed of at least one of the first compressor or the second compressor may be controlled based on a value sensed by the temperature sensor or the weight sensor.

As an example of controlling the drive speed a drive frequency of the inverter may be controlled to be lowered at a specific time point when at least one of the peripheral temperature, the amount of the object, or the amount of initial moisture contained (IMC) in the object is higher than an upper limit value or lower than a lower limit value within the preset or predetermined range.

As discussed above, when the peripheral temperature is higher than a preset or predetermined value, when the amount of the object is larger than a preset or predetermined amount, or when the amount of initial moisture contained (IMC) in the object is larger than a preset or predetermined amount, as shown in FIG. 6, the first heat pump cycle 140, a high pressure side heat pump cycle, may reach a limiting point (a reliable compressor driving region) at a faster speed. In this case, the low side pressure or high pressure side heat pump cycle should be maintained within an operation range turned off and then by being re-operated. While the heat pump cycle is turned off, a loss of a cooling capacity may be caused. This may result in an increase in a drying time and an increase of energy cost (in power consumption of a motor to drive the circulation fan and the drum). In order to safely perform an initial driving of the compressor which has been turned off, a standby time of about 3 minutes is required. The standby time may cause a reduction in drying time. In this embodiment, as at least one of the high pressure side heat pump cycle or the low pressure side heat pump cycle is provided with an inverter, the high pressure side and low pressure side heat pump cycle may be moved to a reliable compressor drive region, as a drive frequency of the at least one compressor is changed. With such a configuration, the compressor may be driven for a long time, and may be continuously driven without turning off the cycle. This may allow the compressor to maintain its performance in a protected state, and may minimize a drying time.

In a first condition in which at least one of the peripheral temperature, the amount of the object, or the amount of initial moisture contained (IMC) in the object is higher than an upper limit value within the specific range, the first and second compressors may have a same drive speed in the first mode. However, in the second mode, one of the first compressor or the second compressor, which has an inverter, may have a lowered drive speed.

Referring to FIG. 7A, in a case in which each of the first and second compressors is provided with an inverter, each of the first and second compressors may be driven in the first mode at a constant speed. Then, if it is determined that at least one of the peripheral temperature, the amount of the object, and the amount of initial moisture contained (IMC) in the object is out of the specific range, the drive speed of the first and second compressors may be erect to execute the second mode. In this case, the first compressor is indicated a dotted line, and the second compressor is indicted as a solid line.

However, embodiments are not limited thereto. For example, if it is determined that at least one of the peripheral temperature, the amount of the object, or the amount of initial moisture contained (IMC) in the object is out of the specific range in the first mode, the drive speed of only one of the first compressor or the second compressors may be lowered.

As another example, a drive frequency of the second compressor, the low pressure side compressor, may be lowered up to an operable size, and then the drive speed of the first compressor, the high pressure side compressor, may be controlled. On the contrary, a drive frequency of the first compressor, the high pressure side compressor may be lowered up to an operable size, and then the drive speed of the second compressor, the low pressure side compressor, may be controlled.

Referring to FIG. 7B, in a case in which the first compressor is provided with an inverter and the second compressor is driven at a constant speed, driving of the compressors may be controlled within a reliable region by lowering the drive speed of the first compressor. Referring to FIG. 7C, in a case in which the second compressor is provided with an inverter and the first compressor is driven at a constant speed, driving of the compressors may be controlled within a reliable region by lowering the drive speed of the second compressor.

As discussed above, in the embodiments disclosed herein, at least one of the first compressor or the second compressor may be driven in the first mode in which the drive speed is constant, and in the second mode in which the drive speed is changed to another speed. In this case, if at least one of the peripheral temperature, the amount of the object, or the amount of initial moisture contained (IMC) in the object is out of the specific range, the controller may drive at least one of the first compressor or the second compressor in the second mode.

Such a drive method may also be applicable in a second condition in which the peripheral temperature is lower than a preset or predetermined temperature, the amount of the object is smaller than a preset or predetermined amount, or when the amount of initial moisture contained (IMC) in the object is smaller than a preset or predetermined amount. In a case of the second condition, as discussed above, it takes a lot of time to reach a constant-rate drying section (region), as both the high pressure side heat pump cycle and the low pressure side heat pump cycle have reduced performance. This may result from a characteristic of a dryer having a heat pump cycle, a different type of dryer from an electric heater that supplies a constant amount of heat all the times. This occurs when a periphery or a drying load has a low enthalpy.

In this case, as shown in FIGS. 8A to 8C, the controller may drive at least one of the first compressor or the second compressor in the second mode. For example, as shown in FIG. 8A, in a case in which each of the first and second compressors is provided with an inverter, each of the first and second compressors may be driven at a high speed in the first mode, thereby accelerating performance of the cycles and inducing a region of high temperature and high humidity (moving to the right-upper region on the phychrometric chart) in which cycle efficiency is increased. With such a configuration, drive efficiency may be enhanced, and a drying time shortened. The controller may then execute the second mode by lowering the drive speed of the first and second compressors. In the second condition, an auxiliary heat source, such as a heater, may be provided.

As another example, referring to FIG. 8B, in a case in which the first compressor is provided with an inverter and the second compressor is driven at a constant speed, the first compressor, the high pressure side compressor, may be initially driven at a high speed. Then, the drive speed of the first compressor may be lowered, thereby accelerating performance of the cycles. As still another example, referring to FIG. 8C, in a case in which the second compressor is provided with an inverter and the first compressor is driven at a constant speed, the second compressor, the low pressure side compressor may be initially driven at a high speed. Then, the drive speed of the second compressor, may be lowered, thereby accelerating growth of the cycles.

Referring to FIG. 9, when an external load is small, a compressor having an inverter and driven at a high speed increases a temperature of air of a drum inlet side (temperature is proportional to amount of heat) more than a constant-speed compressor. When compared with a pressure shift of a constant-speed compressor indicated by the solid line, a pressure shift of a high-speed compressor indicated by the dotted line produces a high discharge pressure and a high pressure ratio, and causes the cycles to rapidly reach a constant-rate drying section.

Referring again to FIG. 5, after the drive speed is changed, the first and second compressors may be driven at a constant speed until a drying process is completed (S140). That is, at least one of the first compressor or the second compressor may be driven in the first and second modes, and then may be driven in a third mode, in which the drive speed is maintained as the second speed.

According to such a method, bad influences on laundry due to high temperature may be reduced by a low-temperature drying operation. In a case of an underwear course more sensitive to temperature, for example, one of the high pressure side cycle or the low pressure side cycle may be driven at a lower speed, in a state in which laundry scarcely has remaining moisture in a final drying stage. As the controller induces a lowered temperature, a state of an object to be dried may be enhanced. Further, as the drive speed of the compressor having an inverter is more controlled, a low-temperature driving region may be widened.

The clothes treating apparatus according to embodiments disclosed herein may be selectively provided with the first and second heat pump cycles. For example, the clothes treating apparatus having a single heat pump cycle may be provided with a mechanism to easily change the single heat pump cycle into a multi-heat pump cycle according to a designer or users selection. Hereinafter, such a mechanism will be explained with reference to the attached drawings.

Figure 10:
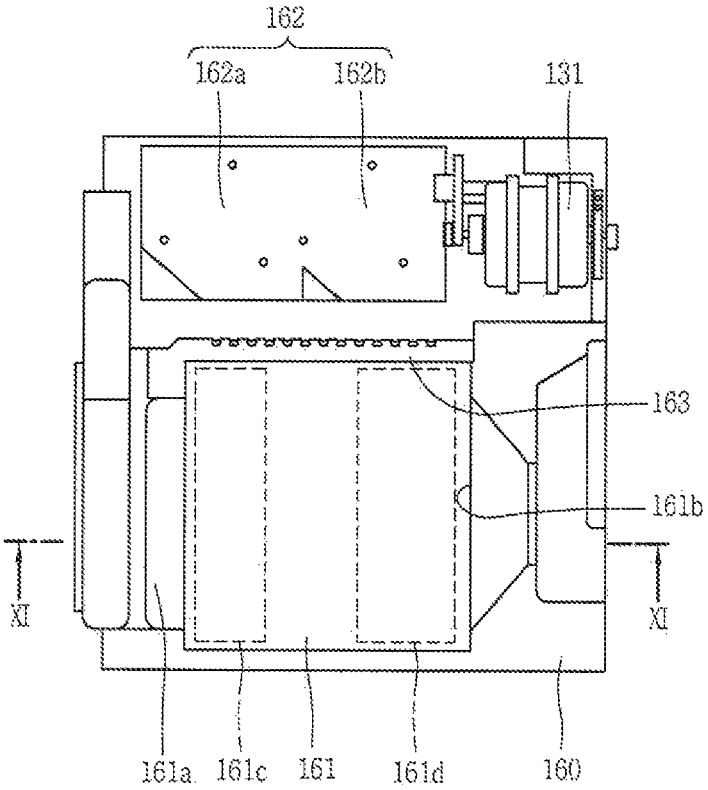
FIG. 10 is a planar view of a base frame provided in the clothes treating apparatus of FIG. 1.
Figure 11:
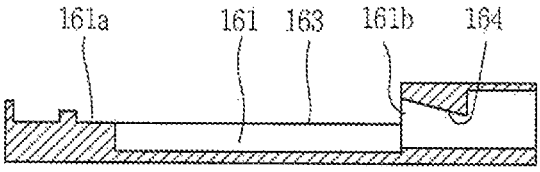
FIG. 11 is sectional view taken along line 'XI-XI' in FIG. 10.
Figure 12:
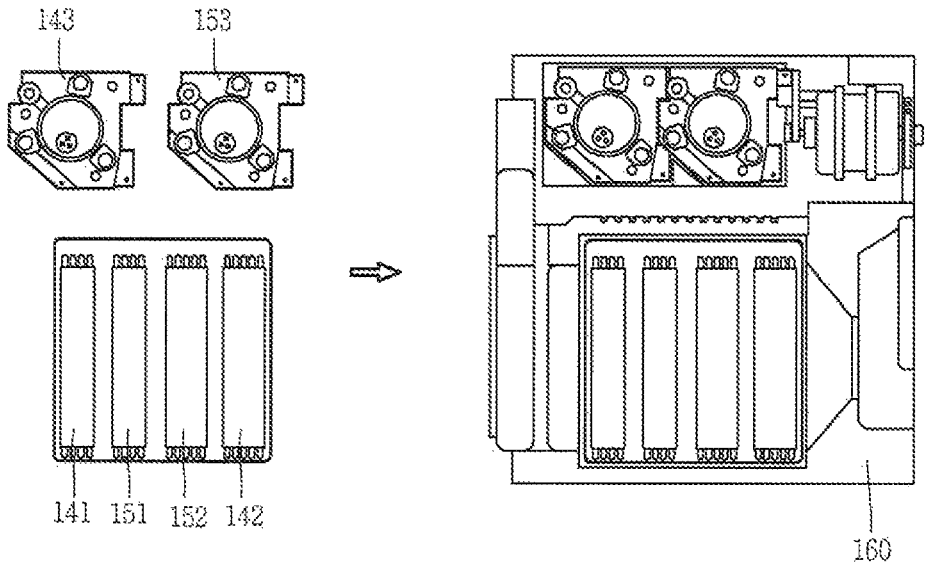
FIGS. 12 to 14 are conceptual views illustrating an evaporator, a condenser, and a compressor mounted to the base frame of FIG. 10.
Figure 13:
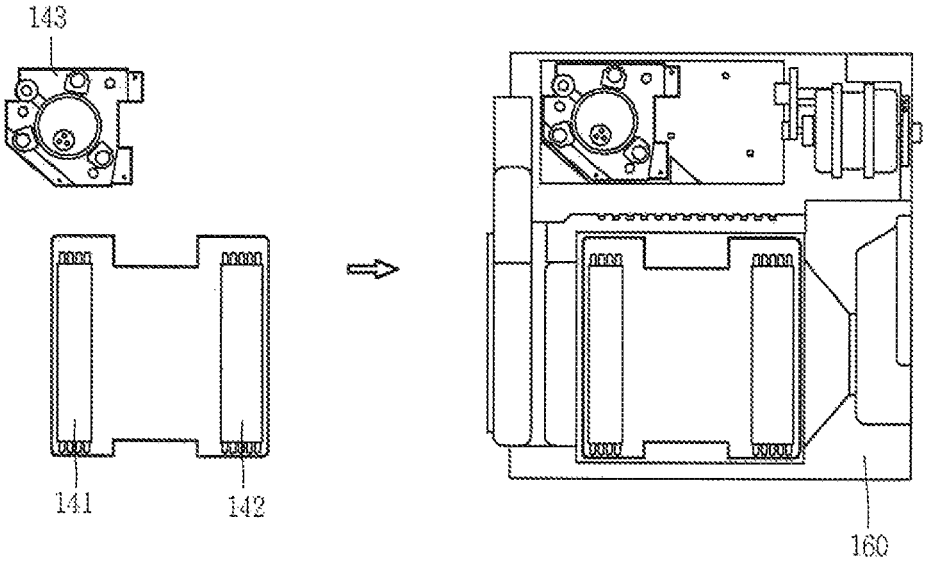
Figure 14:
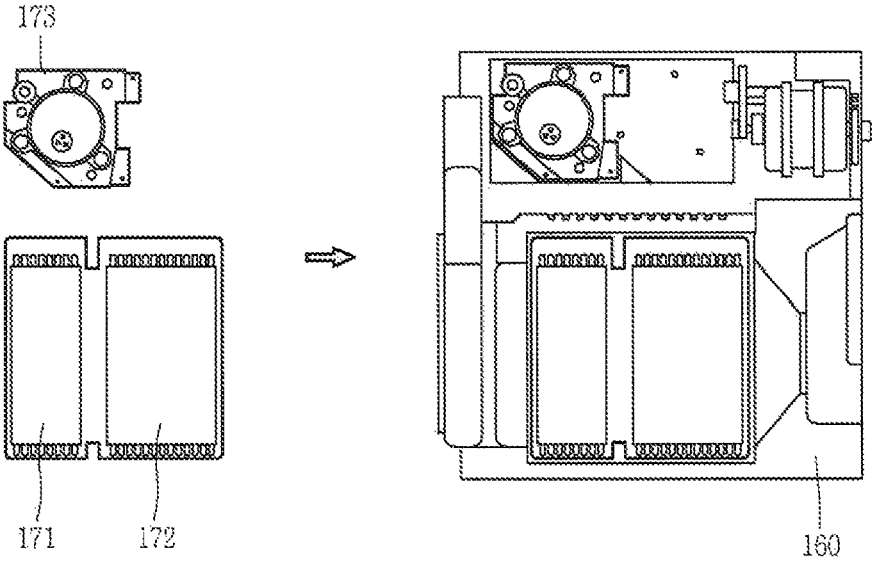

FIG. 10 is a planar view of a base frame provided in the clothes treating apparatus of FIG. 1. FIG. 11 is a sectional view taken along line 'XI-XI' in FIG. 10. FIGS. 12 to 14 are conceptual views illustrating an evaporator, a condenser, and a compressor mounted to the base frame of FIG. 10.

Referring to the drawings, the clothes treating apparatus may be provided with a base frame 160, and at least one evaporator 141, 151, at least one condenser 142, 152, and at least one compressor 143, 153 may be mounted to the base frame 160. More specifically, components of a single heat pump cycle, or components of a multi-heat pump cycle may be mounted to the base frame 160. As discussed above, the at least one condenser 142, 152 may heat air introduced into the drum, and the at least one compressor may be combined with the at least one condenser 142, 152 and the at least one evaporator 141, 151 to form a heat pump cycle.

For example, at least a portion of components of the first heat pump cycle 140, and at least a portion of components of the second heat pump cycle 150 (refer to FIG. 1) may be mounted to the base frame 160 together. In this case, components of the multi-heat pump cycle may be mounted to the base frame 160. As another example, the components of the second heat pump cycle 150 may not be mounted to the base frame 160, but only the components of the single heat pump cycle may be mounted to the base frame 160.

The base frame 160 may be applied to both a single heat pump cycle and a multi-heat pump cycle. That is heat exchanger module and a compressor assembly module may be inserted into the base frame 160 according to each scenario, for efficiency of cost and production. The base frame 160 may have modules inserted thereinto for common use, and may have a flow path. For example, the base frame 160 may be provided with a first accommodation portion 161, a second accommodation portion 162, and a wall or a barrier 163. The wall may be one of a side wall, a party wall, or a boundary wall.

The first accommodation portion 161 may accommodate therein the at least one evaporator 141, 151 and the at least one condenser 142, 152. The first accommodation portion 161 may extend lengthwise in a first direction, so as to extend along a flow direction of air introduced into the drum. As one surface of the first accommodation portion 161 may be recessed, side walls may be formed at two ends and two edges. The two ends may be an air inlet and an air outlet. For example, an inlet 161*a*, through which air may be introduced into the first accommodation portion 161, and an outlet 161*b*, through which air passing through the first accommodation portion 161 to a nozzle portion 164 may be formed at two ends of the first accommodation portion 161. The inlet 161*a* and the outlet 161*b* may be an entrance and an exit of the flow path, which may be formed at two sides of the first accommodation portion 161.

The second accommodation portion 162 may accommodate the at least one compressor 143, 153 therein, and may be arranged in parallel to the first accommodation portion 161. The second accommodation portion 162 may extend in a direction parallel to the first direction. A plurality of compressor mounts 162*a*, 162*b* may be arranged at or in the second accommodation portion 162, along the flow path of the first accommodation portion 161.

The wall 163 may partition the first and second accommodation portions 161, 162 from each other, such that the flow path may be formed at the first accommodation portion 161. Thus, the partition 163 may form a side wall of the first accommodation portion 161, and a side wall of the second accommodation portion 162.

The first accommodation portion 161 may include a first mount 161*c* that mounts the first evaporator 151, and a second mount 161*d* that mounts the first condenser 142. As the first evaporator 141 and the first condenser 142 are included in the first heat pump cycle 140, components of the first heat pump cycle 140 may be mounted to the first and second mounts 161*c*, 161*d*. Thus, the at least one evaporator and the at least one condenser may be arranged at two sides of the first accommodation portion 161, and the clothes treating apparatus may be provided with a single heat pump cycle as shown in FIG. 13.

In this case, a compressor may be provided at or in only one of the plurality of compressor mounts 162*a*, 162*b*, such that air introduced into the drum may be heated by a single heat pump cycle. More specifically, the first compressor 143 may be mounted to one of the plurality of compressor mounts 162*a*, 162*b*, and another compressor mount may remaintain an empty space or empty.

As another example, components of the second heat pump cycle 150 may be arranged between the first and second mounts 161*a*, 161*b*. In this case, as shown in FIG. 12, air introduced into the drug may be heated by the first and second heat pump cycles 140, 150.

Referring to FIGS. 10, 11, and 12, the second evaporator 151 and the second condenser 152 provided at the second heat pump cycle 150 may be arranged between the first and second mounts 161*a*, 161*b*. For this, the first and second mounts 161*a*, 161*b* may be spaced from each other along the wall 163 such that a space may be formed between the first evaporator 141 and the first condenser 142, and the second evaporator 151 and the second condenser 152 may be arranged at or in the space. With such a structure, the first and second heat pump cycles 140, 150 may be arranged such that air introduced into the first accommodation portion 161 may pass through the first evaporator 141, the second evaporator 151, the second condenser 152 and the first condenser 142, sequentially.

As shown, the first compressor 143 of the first heat pump cycle 140 may be arranged at one of the plurality of compressor mounts 162*a*, 162*b*, and the second compressor 153 of the second heat pump cycle 150 may be arranged at another of the plurality of compressor mounts 162*a*, 162*b*. In this case, at least one of the first compressor 143 or the second compressor 153 may be provided with an inverter that varies a drive speed of the respective compressor through a frequency conversion. With such a configuration, the method discussed above with reference to FIGS. 1 to 9 may be implemented.

A motor 131 of a fan, configured to suction air passing through the flow path, may be mounted to the base frame 160. The fan may be the circulation fan 130 (refer to FIG. 1), and the motor 131 of the circulation fan 130 may be mounted to the base frame 160 for support. In this case, the motor 131 may be arranged close to the second accommodation portion 162, in a direction parallel to the first accommodation portion 161. With such a structure, the circulation fan 130 may be integrated with the components of the first and second heat pump cycles 140, 150 through the base frame 160.

As another example, as shown in FIGS. 11 and 13, compressors 143, 173 having different capacities may be selectively mounted to the base frame 160 in a single heat pump cycle. More specifically, the third compressor 173 having a larger capacity than the first compressor 143 may be mounted to one of the plurality of compressor mounts 162*a*, 162*b*. A third evaporator 171 having a larger capacity than the first evaporator 141, and a third condenser 172 having a larger capacity than the fir condenser 142 may be mounted to the first accommodation portion 161. In this case, components of the third evaporator 171 and the third condenser 172, which may be larger in volume than the first evaporator 141 and the first condenser 142, may be arranged between the first and second mounts 161*a*, 161*b* of the first accommodation portion 161.

With such a structure, single heat pump cycle of a different capacity may be selectively mounted to the base frame.

The clothes treating apparatus having the base frame according to embodiments disclosed herein may correspond to a cycle formed by a combination of the examples discussed above. Such a combination may be variously implemented according to a capacity of a compressor, a number of heat exchangers, or a variable, such as capacity, according to whether an inverter is provided or not, for example.

Embodiments disclosed herein provide a clothes treating apparatus having a heat pump cycle, capable of reducing a drying time by enhancing a dehumidification function. Embodiments disclosed herein further provide a clothes treating apparatus having a multi-heat pump cycle, and capable of being operated in a wide range of drive conditions. Embodiments disclosed herein further provide a clothes treating apparatus capable of corresponding to each of a single heat pump cycle and a multi-heat pump cycle.

Embodiments disclosed herein provide a clothes treating apparatus that may include an accommodation chamber, in which an object may be accommodated; a first heat pump cycle having a first evaporator, a first compressor, a first condenser, and a first expansion valve; a second heat pump cycle having a second evaporator, a second compressor, a second condenser, and a second expansion valve, and arranged such that air introduced into the accommodation chamber passes through the first evaporator, the second evaporator, the second condenser, and the first condenser, sequentially; and a controller configured to control an operation of the first and second heat pump cycles. At least one of the first compressor or the second compressor may be provided with an inverter to change a drive speed of the compressor through a frequency conversion, and the controller may drive at least one of the first compressor or the second compressor within a preset or predetermined drive range, by controlling the drive speed of at least one of the first compressor or the second compressor using the inverter.

At least one of the first compressor or the second compressor may be driven in a first mode where the drive speed is constant as a first speed, and a second mode where the drive speed is varied from the first speed to a second speed. When at least one of a peripheral temperature, an amount of the object, or an amount of initial moisture contained (IMC) in the object is out of a specific range, the controller may control at least one of the first compressor or the second compressor to be driven in the second mode.

A driving frequency of the inverter may be controlled to be lowered at a specific time point when at least one of the peripheral temperature, the amount of the object, or the amount of initial moisture contained (IMC) in the object is higher than an upper limit value or lower than a lower limit value within the specific range. In a case where at least one of the peripheral temperature, the amount of the object or the amount of initial moisture contained (IMC) in the object is higher than an upper limit value within the specific range, the first and second compressors may have the same drive speed in the first mode, and one of the first and second compressors which has an inverter may have its drive speed lowered in the second mode. At least one of the first compressor or the second compressor may be driven in the first and second modes, and then may be driven in a third mode where the drive speed is maintained as the second speed.

The controller may control the drive speed of at least one of the first compressor or the second compressor, based on a condensation temperature of the condenser or a discharge temperature of the compressor, the temperature sensed on at least one of the first heat pump cycle or the second heat pump cycle. If the condensation temperature of the condenser or the discharge temperature of the compressor is out of a preset or predetermined range, the controller may determine that at least one of the peripheral temperature, the amount of the object, or the amount of initial moisture contained (IMC) in the object is out of the specific range.

The preset drive range may indicate a compression ratio range, and the second compressor may be formed to have a larger compression ratio than the first compressor. The second compressor may be provided with an inverter, and the first compressor may be driven at a constant speed.

Embodiments disclosed herein further provide a clothes treating apparatus that may include a drum in which an object may be accommodated; at least one evaporator; at least one condenser configured to heat air introduced into the drum; at least one compressor configured to form a heat pump cycle by being combined with the at least one condenser and the at least one evaporator; and a base frame including a first accommodation portion that accommodates the at least one evaporator and the at least one condenser, a second accommodation portion arranged in parallel to the first accommodation portion and that accommodates the at least one compressor, and a wall formed to partition the first and second accommodation portions from each other such that a flow path may be formed at the first accommodation portion.

A first mounting portion or mount that mounts the first evaporator, and a second mounting portion or mount that mounts the first condenser may be formed at the first accommodation portion. The first and second mounting portions may be spaced from each other along the wall, such that a space may be formed between the first evaporator and the first condenser.

Air introduced into the drum may be heated by first and second heat pump cycles. The first evaporator and the first condenser may be provided at the first heat pump cycle, and a second evaporator and a second condenser provided at the second heat pump cycle may be arranged between the first and second mounting portions. An entrance and an exit of the flow path may be formed at two sides of the first accommodation portion, and the at least one evaporator and the at least one condenser may be arranged at two sides of the first accommodation portion. A plurality of compressor mounting portions or mounts may be arranged at the second accommodation portion along the flow path of the first accommodation portion.

Air introduced into the drum may be heated by first and second heat pump cycles. The first compressor of the first heat pump cycle may be arranged at one of the plurality of compressor mounting portions, and the second compressor of the second heat pump cycle may be arranged at another of the plurality of compressor mounting portions. At least one of the first compressor or the second compressor may be provided with an inverter that changes a drive speed of the compressor through a frequency conversion. The first heat pump cycle may be provided with a first evaporator and a first condenser, and the second heat pump cycle may be provided with a second evaporator and a second condenser. The first and second heat pump cycles may be arranged such that air introduced into the first accommodation portion passes through the first evaporator, the second evaporator the second condenser, and the first condenser, sequentially.

A compressor may be arranged at one of the plurality of compressor mounting portions, and no compressor may be arranged at another of the compressor mounting portions, such that air introduced into the drum may be heated by a single heat pump cycle. A motor of a fan that suctions air passing through the flow path may be mounted to the base frame. The motor may be arranged close to the second accommodation portion, in a direction parallel to the first accommodation portion.

Embodiments disclosed herein may have at least the following advantages.

Firstly, a dehumidification function and a drying function may be enhanced through a multi-heat pump cycle, and a drying time may be shortened. Secondly, a heat pump cycle may be driven within a wide range of operation, by a compressor having an inverter. With such a configuration, even if a peripheral temperature, an amount of the object, or an amount of initial moisture contained (IMC) in the object is out of a specific range, the heat pump cycle may be driven within a reliable range of the compressor. Also, a drying function at a low temperature may be implemented through a multi-heat pump cycle, and a drive range of the heat pump cycle at a low temperature may be widened through a frequency conversion by the inverter.

Further, a structure of a dryer, commonly used to a single heat pump cycle and a multi-heat pump cycle, may be implemented through a base frame having a plurality of accommodation portions. Furthermore, as a flow path may be formed by a wall of the plurality of accommodation portions and components are arranged in the flow path, air flow having a small loss may be implemented regardless of an arrangement of the components.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising an accommodation chamber, in which an object is accommodated;

a first heat pump cycle having a first evaporator, a first compressor, a first condenser, and a first expansion valve;

a second heat pump cycle having a second evaporator, a second compressor, a second condenser, and a second expansion valve, and arranged such that air introduced into the accommodation chamber passes through the first evaporator, the second evaporator, the second condenser, and the first condenser, sequentially; and a controller configured to control an operation of the first and second heat pump cycles, wherein at least one of the first compressor or the second compressor includes an inverter that changes a drive speed of the respective compressor through a frequency conversion, wherein the controller drives the at least one of the first compressor or the second compressor within a predetermined drive range, by controlling the drive speed of the at least one of the first compressor or the second compressor using the inverter, wherein at least one of the first compressor or the second compressor is driven in a first mode in which the drive speed is constant as a first speed, and a second mode in which the drive speed is varied from the first speed to a second speed and wherein at least one of the first compressor or second compressor is driven in the first and second modes, and then is driven in a third mode in which the drive speed is maintained as the second speed.

2. The clothes treating apparatus of claim 1, wherein when at least one of a peripheral temperature, an amount of the object, and an amount of initial moisture contained (IMC) in the object is out of a predetermined range, the controller controls the at least one of the first compressor or the second compressor to be driven in the second mode.

3. The clothes treating apparatus of claim 2, wherein a drive frequency of the inverter is controlled to be lowered at a specific time point when at least one of the peripheral temperature, the amount of the object, or the amount of initial moisture contained (IMC) in the object is higher than an upper limit value or lower than a lower limit value within the predetermined range.

4. The clothes treating apparatus of claim 2, wherein in a case in which at least one of the peripheral temperature, the amount of the object, or the amount of initial moisture contained (IMC) in the object is higher than an upper limit value within the predetermined range, the first and second compressors have a same drive speed in the first mode, and the at least one of the first compressor or the second compressor which has the inverter has its drive speed lowered in the second mode.

5. The clothes treating apparatus of claim 1, wherein the controller controls the drive speed of the at least one of the first compressor or the second compressor, based on a condensation temperature of the respective condenser or a discharge temperature of the respective compressor.

6. The clothes treating apparatus of claim 5, wherein if the condensation temperature of the respective condenser or the discharge temperature of the respective compressor is out of a predetermined range, the controller determines that at least one of a peripheral temperature, an amount of the object, and an amount of initial moisture contained (IMC) in the object is out of a predetermined range.

7. The clothes treating apparatus of claim 1, wherein the predetermined drive range indicates a compression ratio range, and wherein the second compressor has a larger compression ratio than the first compressor.

8. The clothes treating apparatus of claim 7, wherein the second compressor is provided with an inverter, and the first compressor is driven at a constant speed.

9. The clothes treating apparatus of claim 1, wherein the accommodation chamber is a drum.

10. A clothes treating apparatus, comprising:

an accommodation chamber, in which an object is accommodated;

a first heat pump cycle having a first evaporator, a first compressor, a first condenser, and a first expansion valve;

a second heat pump cycle having a second evaporator, a second compressor, a second condenser, and a second expansion valve, and arranged such that air introduced into the accommodation chamber passes through the first evaporator, the second evaporator, the second condenser, and the first condenser, sequentially; and a controller configured to control an operation of the first and second heat pump cycles, wherein at least one of the first compressor or the second compressor includes an inverter that changes a drive speed of the respective compressor through a frequency conversion, wherein the controller drives the at least one of the first compressor or the second compressor within a predetermined drive range, by controlling the drive speed of the at least one of the first compressor or the second compressor using the inverter, wherein a drive frequency of the inverter is controlled to be lowered at a specific time point when at least one of a peripheral temperature, an amount of the object, or an amount of initial moisture contained (IMC) in the object is higher than an upper limit value or lower than a lower limit value within a predetermined range.

11. A clothes treating apparatus, comprising:

an accommodation chamber, in which an object is accommodated;

a first heat pump cycle having a first evaporator, a first compressor, a first condenser, and a first expansion valve;

a second heat pump cycle having a second evaporator, a second compressor, a second condenser, and a second expansion valve, and arranged such that air introduced into the accommodation chamber passes through the first evaporator, the second evaporator, the second condenser, and the first condenser, sequentially; and a controller configured to control an operation of the first and second heat pump cycles, wherein at least one of the first compressor or the second compressor includes an inverter that changes a drive speed of the respective compressor through a frequency conversion, wherein the controller drives the at least one of the first compressor or the second compressor within a predetermined drive range, by controlling the drive speed of the at least one of the first compressor or the second compressor using the inverter, wherein in a case in which at least one of a peripheral temperature, an amount of the object, or an amount of initial moisture contained (IMC) in the object is higher than an upper limit value within a predetermined range, the first and second compressors have a same drive speed in a first mode, and the at least one of the first compressor or the second compressor which has the inverter has its drive speed lowered in a second mode.

* * * * *